United States Patent [19]

Chen

[11] 4,202,514

[45] May 13, 1980

[54] HYDRAULIC JACK DEVICE

[76] Inventor: Cheng-Kuan Chen, 48, Kuang Ming Rd., Chia-Yi City, Taiwan

[21] Appl. No.: 970,205

[22] Filed: Dec. 18, 1978

[51] Int. Cl.[2] ..... B66F 3/24

[52] U.S. Cl. ..... 254/93 H; 92/5 R

[58] Field of Search ..... 254/93 R, 93 H; 92/5 R

[56] References Cited

U.S. PATENT DOCUMENTS

| | | | |
|---|---|---|---|
| 2,153,845 | 4/1939 | Rosenberry | 254/93 H |
| 3,499,601 | 3/1970 | Laerdal | 92/5 R |
| 3,806,091 | 4/1974 | Wride | 254/93 R |

*Primary Examiner*—Robert C. Watson

[57] ABSTRACT

The present invention is an improved jack device which comprises mainly a jack body, a plunger pump, a base seat and an oil passage device. The outer cylinder of the jack body is made of transparent, semi-transparent plastic material or the like, cylindrical in shape with calibration marked on its wall for indicating oil level, has a soft tube nozzle insetting its wall with a soft tube attached thereto and disposed in the enclosed space of the outer cylinder and is communicable with plunger pump, thereby enabling the reading of the oil amount and the use of the device in inclined positions. Further, the cylinder of the jack body and the cylinder of the plunger pump are formed with base portions by direct forging, are cylindrical in shape and inserted into the corresponding holes of the base seat, firmly fixed on the base seat by welding, making both of them oil-leak proof. Besides, the base seat has no oil passage bored in it, so it can be a relatively thin iron plate and its area can be increased at will according to practical necessity without creating any trouble.

4 Claims, 6 Drawing Figures

HYDRAULIC JACK DEVICE

BACKGROUND OF THE INVENTION

1. Field of the Invention

The present invention relates to an improved hydraulic jack device which particularly provides improved outer cylinder, base seat, oil passage and soft tube device placed in the outer cylinder for use of the present invention in inclined positions, and in addition, eliminates the general defects of known hydraulic jacks.

2. Description of the Prior Art

The known hydraulic jacks are varied in type but can generally be classified into three main types, namely, the integral type, the sectional type, and the particular purpose type. The structure of the jacks generally comprises three main parts, namely, the jack body, the plunger pump and the oil passage. To make clear the structure and defects of the known hydraulic jacks, the example of a vertically standing hydraulic jack is hereby described and illustrated. The jack body and the plunger pump of the hydraulic jack are longitudinally arranged and the oil passage is bored in the base seat under the jack body and the plunger pump, permitting the oil passage to pass and make communicable the oil between the plunger pump, the outer cylinder and the inner cylinder of the jack body.

Referring to FIG. 1, where in is shown the vertical sectional view of the known hydraulic jack. Its main structure comprises a jack body 1, a base seat 2, a plunger pump 3, and an oil passage 4 which is used for conducting the oil between the jack body and the plunger pump. The jack body further comprises mainly an outer cylinder 5, an inner cylinder 6, a ram 7 with auxilliary screw (not shown), a saddle 9 attached to the top of the ram and a flange 10 which encases the inner cylinder 6 and the outer cylinder 5. The outer cylinder is cylindrical in shape, the upper extremity thereof is welded to the flange 10, and the lower extremity thereof is welded to the base seat 2, and on the cylinder wall thereof is bored an oil filling hole. Conventional method is to fill the oil container with oil then forever seal the oil filling hole, other methods are to use rubber stopper and screw to tightly seal the hole. Further, the inner cylinder has a ram whose function is similar to that of a piston, when high pressure oil flows in through a hole on the wall, the bottom of the ram is pushed and it rises slowly. Generally an auxilliary screw is attached to the ram for adjusting the head of the jack under particular condition; on the ram is disposed a saddle to support the object to be raised. In addition, the inner cylinder 6 of known jack is screwed or welded to the base seat, generally the lower extremity is equipped with copper cushioning material and is directly communicable with a high pressure oil passage. On the wall of the inner cylinder 6 is an oil releasing hole 11 and an air discharging hole 12. The function of the oil discharging hole 11 is to permit the high pressure oil to discharge to the outer cylinder 5 through the hole, when the ram, being pushed by high pressure oil injected into the inner cylinder 6, rises above the oil discharging hole 11, thus maintaining a constant head for the jack and avoiding the ejection of the ram out of the inner cylinder or the collision with the flange. The function of the air releasing hole is to avoid the existence of a vacuum state created in the inner cylinder 5 and the outer cylinder 6 due to the reduction of the oil amount in either the inner cylinder or the outer cylinder, or the up and down movement of the ram (piston), which influences the movement characteristic of the jack.

The construction of the plunger pump adjacent to the jack body further includes a lever support 13 that can be inserted with a swinging lever, a hinge bracket 14 and a plunger pump 8. To have a clearer understanding of the operation of known hydraulic jack, please refer to FIG. 2 which shows the oil passage of the jack. When employing the jack to lift heavy object, insert the handle lever to the lever support 13 and start the plunger pump. When the plunger of the plunger pump rises, the oil from outer cylinder 5 flows into the plunger cylinder through the oil passage and check valve, when pressurized, the oil flows into the inner cylinder 6 through another check valve, driving the ram to move upward, thus, after repeated exercise of the plunger pump, the object can be lifted by the saddle by means of the ram, or be moved along the desired direction. To lower the ram 7, simply open the valve rod of the oil releasing valve on the base seat 2, and the high pressure oil will be released from the inner cylinder to the outer cylinder, and this completes a cycle of operation of the jack.

The members of the known hydraulic jack mentioned above are mostly casted or made of iron and because of the members and the assemblage thereof, the jack has the following defects and/or disadvantages: a complex manufacturing process, because the members are mostly assembled by welding, oil leak easily happens and thus influences the head of the ram of the jack, and the remaining oil amount cannot be known, therefore the characteristic of the jack cannot be qualitatively and accurately guaranteed. Further, because the oil passage is directly bored in the base seat or the like, if the surface area of the base seat has to be enlarged to avoid the toppling of the jack frequently because of deviation of the center of gravity in the process of loading the jack, the oil passage has to be lengthend, therefore, the difficulty of boring passage in the base seat is greatly increased. Besides, the iron dust in the oil passage in the base seat of the prior art hydraulic jack cannot be completely cleared, the working agent oil of the jack will be contaminated easily, causing damages to the members and influencing the characteristic of the jack. In addition, the defects and/or disadvantages of the prior art hydraulic jack, because of the limitation of the above-mentioned structural members, also include easy leakage of oil in the outer cylinder and difficulty in replacing it, incapability of being willfully used in inclined positions, easy toppling when being used, base seat being too thick, etc. A lot of inconveniences occur when being used. Therefore, a kind of new hydraulic jack which does not possess the above-mentioned defects or disadvantages of the known hydraulic jack urgently needs to be developed.

SUMMARY OF THE INVENTION

The object of the present invention is to provide a kind of hydraulic jack which is oil-leak proof, capable of being used in inclined positions, uneasy to topple, and which can maintain good characteristic.

Therefore, the present invention provides improved outer cylinder, base seat and oil passage device of a hydraulic jack. The said outer cylinder is made of plastic material or the like with an oil level calibration marked at a suitable region on the cylinder wall so that when oil is injected into the cylinder, the oil amount can be read out easily using the calibration, and when there is loss due to leakage, the loss can be detected and suitable amount of oil be added. An oil injection hole is bored at a region of suitable height on the cylinder wall, the said oil injection hole is sealed by a bolt and a stopper which are to be opened when refilling is necessary. And a tube is disposed on the cylinder wall of the outer cylinder and is in communication with the inner cylinder so that when the oil in the outer cylinder is sucked into the cylinder of the plunger pump, the air in the space below the ram and within the inner cylinder flows into the outer cylinder to avoid the creation of a semi-vacuum state in the outer cylinder because of the decrease in the oil amount and the greater effort that has to be exerted on the handle lever of the plunger cylinder section. The function of the oil tube further includes the leading out of the high pressure oil from the inner cylinder to the outer cylinder when the ram in the inner cylinder moves upward due to the action of the high pressure oil from the plunger pump and the high pressure oil rises above the oil releasing hole on the cylinder wall, and thus avoid damage to the ram and other related members because of tight pressing.

A further characteristic of the present invention is the provision of a soft tube device disposed at the low pressure oil nozzle of the inner cylinder that is communicable with the plunger pump. One end of the soft tube is attached to the said low pressure oil nozzle and the other end is located in the enclosed space of the hollow wall of the outer cylinder and is inserted with a metallic short tube or other similar tubes of high specific gravity, so that when the jack is used in an inclined position, the oil in the outer cylinder can still be sucked into the cylinder of the plunger pump.

A still further characteristic of the present invention is the provision of a thin metallic pipe or the like that encases the plastic outer cylinder to protect the cylinder wall which is made of plastic or the like, and is used to fix the outer cylinder on the base seat. To attain the object, the typical method is to make a groove around the hole on the base seat, then insert the outer cylinder and its protective metallic pipe into the groove and weld the metallic pipe and the base seat. The said outer cylinder and the metallic pipe are in corresponding position, that is, the oil level calibration and oil injection hole of the outer cylinder will not be covered up by the metallic pipe.

Another characteristic of the present invention is the direct insertion of the plunger cylinder into the hole bored at suitable position on the base seat and the welding of the cylinder and the base seat. This makes the plunger pump firmly fixed on the base seat and the pump oil-leak proof. For that purpose, the plunger pump is made by foreging.

Still another characteristic of the present invention is the elimination of the disposition of the oil passage in the base seat, for the oil passage is directly interconnected between the jack body and the plunger pump outside the base seat. Thus, the base seat is thinner but of suitable thickness and its base area can be willfully increased, making the jack stable and difficult to topple. In addition, because holes are bored to provide for the jack body and the plunger cylinder, the weight of the base seat is greatly decreased.

DETAILED DESCRIPTION OF THE INVENTION

Figure 3:
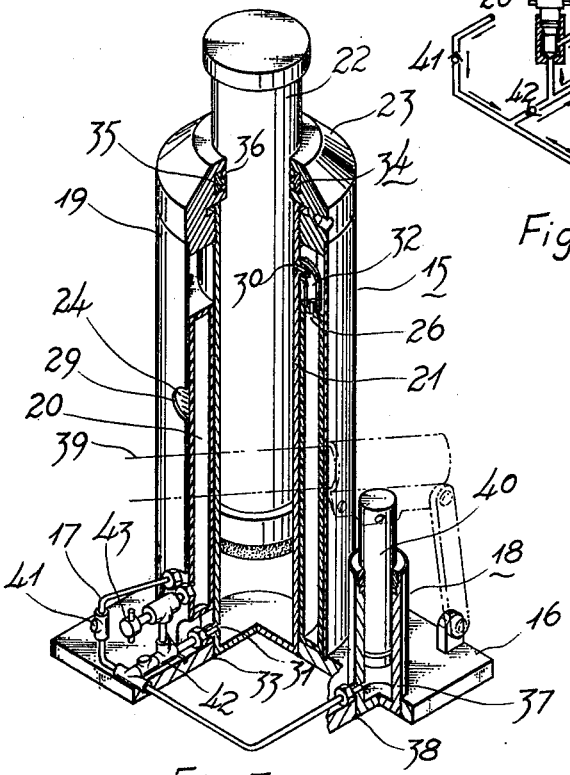
FIG. 3 is a partial vertical sectional view of the present invention.

In order to let the examiner have a thorough understanding of the construction and characteristics of the present invention, an embodiment of the present invention including drawings is described in detail in the following. Further, it should be understood that the drawings and the described example are only a preferred embodiment of the present invention. Within the spirit and technical ideas as revealed by the present invention, other objects can also be made. Referring to FIG. 3, which is partial vertical sectional view of the present invention—an improved hydraulic jack device, the present invention comprises mainly a jack body 15, a base seat 16, an oil passage 17 and a plunger pump 18. In the construction, the oil in the jack body is communicable with the plunger pump by means of an oil passage pipe 17, and to avoid the occurrence of oil leak due to vibration and collision in the process of using or transportation, it is preferrable that the oil passage pipes, the switches and connections be covered with a suitable protective mask. In addition, the oil passage pipe design as shown in FIG. 3 can also be made similar to that of the conventional sectional type hydraulic jack, in which the plunger pump is separated from the jack body, but this is not a characteristic of the present invention, it is a well known technique and will not be described herewith. Furthermore, the jack body 15 comprises mainly an outer cylinder encased by a metallic pipe 19, an inner cylinder 21, a ram 22 and a flange 23, wherein the outer cylinder 20 is preferrably made of transparent plastic material or the like, framed as a cylindrical pipe with hollow wall of rectangular cross section, and has calibration marked at a suitable region on the wall for indicating oil storage. On the wall of the outer cylinder 20, there are an oil passage hole 25, an oil injection hole 26, a soft tube nozzle 27 and a U shape notch for accomodating the oil pipe going into the inner cylinder. To avoid damage to the plastic material or the like due to collision, the outer wall of the outer cylinder is preferrably encased by an metallic pipe of suitable thickness, the metallic pipe is a cylindrical pipe and has an opening 29 made at a region on its wall corresponding to the oil level calibration on the outer wall of the outer cylinder, for the purpose of observing the oil level. To inject oil into the outer cylinder of the present invention, the act may be accomplished by injecting oil through the oil injection hole 26 before the assemblage of the jack body, or by drilling an oil injection hole on the outer wall of the outer cylinder that can be sealed by a bolt and a stopper and filling in the required amount of oil, and can be opened when refilling is needed.

In addition, the inner cylinder 21 of the present invention is formed with a base by forging, is cylindrical in shape, has on its wall an oil releasing hole which can communicate with the oil injection hole 26 of the outer cylinder 20 by means of a tube 32, and an oil passage hole 31. Inner cylinder 21 is inserted directly into the hole on the base seat 16, and both are welded as indicated by 33 in the drawing. The ram 22 of the present invention is placed in the inner cylinder 21, and has adjustable screw thread and saddle attached to it, its function and effect are generally similar to the prior art jack and will not be described herewith. Further, the flange 23 is screwed tightly to the wall of the inner cylinder, making the outer cylinder and the inner cylinder closely in contact with each other and the ram stably disposed in the inner cylinder, this arrangement is similar to that of the prior art, but in the inner wall of the flange of the present invention is disposed a T shape oil ring 34, the T shape portion 35 is made of rubber material and the rod type rings 36 disposed on both sides of 35 are made of nylon material, its superiority lies in its greater ability to prevent oil from leaking out, as compared with ordinary circular type oil ring.

In addition, the base seat of the present invention is directly made of iron plate as compared with the tediousness in the formation of the base seat of the prior art which is casted and has oil passage bored in it. The base seat of the present invention is bored with two holes, one of the hole is for accomodating the inner cylinder of the jack body and the other is for the plunger cylinder of the plunger pump 18, the cylinders and the base seat are fixedly engaged by welding, as indicated by engaging points 33 and 38 in the drawing. Because the base seat has two holes bored on it, therefore its weight is greatly decreased and its base area can be willfully altered according to necessity without any difficulty. Of course, to make the base seat of the present invention more stable and strong, convex reinforcement is formed diagonally on the four corners (not shown).

Furthermore the plunger pump of the present invention has its plunger cylinder formed with a base portion by forging, inserted into the base hole and fixed by welding as compared with the plunger pump of the prior art described above. Its superiority lies in that there will be no oil leakage even when the handle lever drives the plunger with the plunger cylinder placed in an inclined position. The prior art plunger cylinder 8 is cylindrical in shape and without a base portion, and is screwed to the base seat 2. Leakage of high pressure oil occurs easily because of the loosening of the engagement between the plunger cylinder 8 and the base seat 2.

Figure 1:
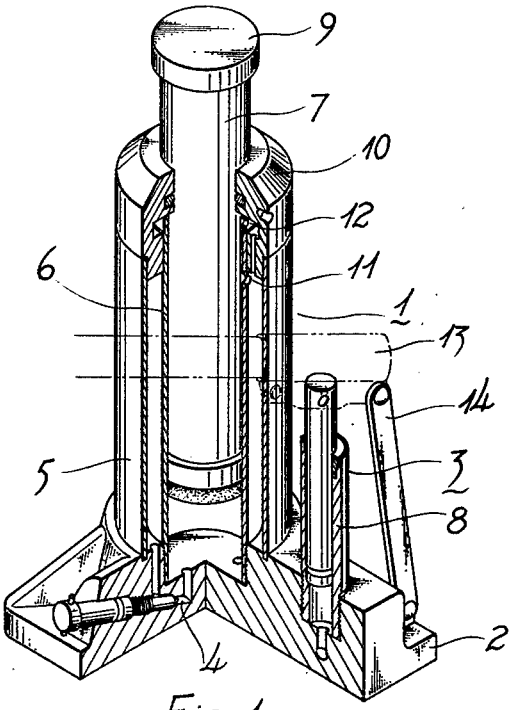
FIG. 1 is a vertical sectional view of prior art hydraulic jack.
Figure 2:
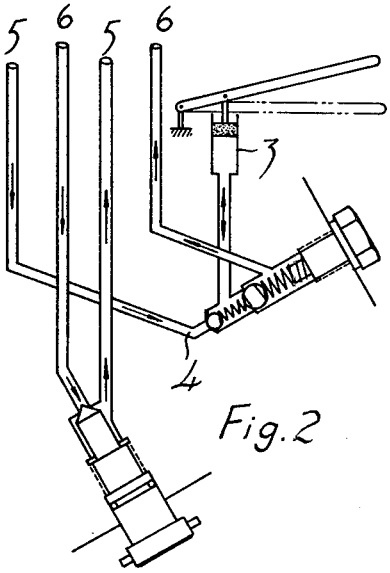
FIG. 2 is an illustrated view of the oil passage of the prior art hydraulic jack.
Figure 4:
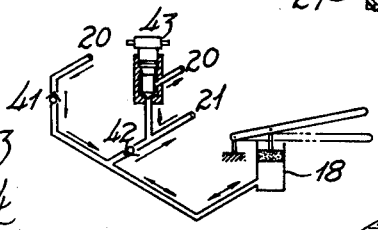
FIG. 4 is an illustrated view of the oil passage of the present invention.
Figure 5B:
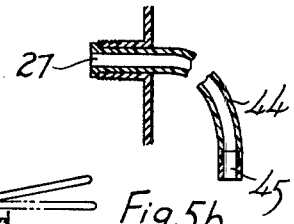
FIG. 5*b* is an illustrated view of the soft tube of the outer cylinder of the present invention.
Figure 5A:
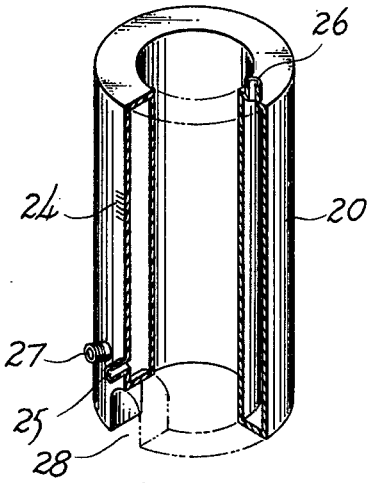
FIG. 5*a* is a partial vertical sectional view of the outer cylinder of the present invention.

To make clear the operation of the present invention, the operation process is described in detail as follows:

Referring to FIG. 4, which is an illustrated view of the oil passage. When using the present invention to lift an object, the handle lever 39 has to be pushed and pulled to move the plunger 40, in the process, the oil in the outer cylinder 20 is sucked into the plunger cylinder 37 through a check valve 41 and pressed, the pressurized oil flows into the inner cylinder 21 through another check valve 42 and pushes the ram 22 upward, repeated operation of the above process will lift the object to be raised. To avoid unlimited upward motion of the the ram, when the high pressure oil rises above the oil releasing hole, the high pressure oil in the inner cylinder 21 flows into the outer cylinder 20 through an oil pipe 32 and the oil injection oil 26, and the head of the jack is limited. To make the ram 22 to revert to its original position, simply open an oil releasing valve 43, the high pressure oil in the inner cylinder 21 will flow back to the outer cylinder 20 through the oil releasing valve 43, this completes an operational cycle of the present invention. Furthermore, to make clear the whole structure of the present invention, particularly the structure of the outer cylinder and its characteristic that brings into being the whole structure of the present invention, the above mentioned structure is described in detail as follows in pairing with accompanying drawings FIGS. 5*a* and 5*b* which are a partial vertical sectional view of the outer cylinder of the present invention, and the sectional view of the soft tube respectively. The inner cylinder is formed with a base portion by forging, the cylinder is fixed in the corresponding hole of the base seat and they are welded together, then the outer cylinder 20 is introduced onto the inner cylinder and the oil is injected into the outer cylinder through the oil injection hole 26. Referring to FIG. 5 wherein is shown the structural view of the outer cylinder 20, which is a metallic pipe with a hollow wall of rectangular cross section, and on which are disposed the oil injection hole 26, the oil passage hole 25, the soft tube nozzle 27 and the U shape notch, the soft tube nozzle is made communicable with plunger pump 18. One end of the soft tube is connected to the inner end of the nozzle which extends through the outer wall of the outer cylinder 21 and the soft tube 44 bends inwardly and downwardly, the other end of the soft tube is attached a metallic tube 45, or a sleeve made of material of high specific gravity, in such way, no matter how the oil in the outer cylinder is inclined with respect to the soft tube nozzle, there is still oil in the outer tube 20 that can be sucked into the plunger pump, therefore, the present invention can be used at any inclined position. The oil passage hole 25 is communicable with the inner cylinder by means of an oil passage pipe and the oil releasing valve 43, so that when the oil is to be released by opening the oil releasing valve 43, the high pressure oil in the inner cylinder 21 flows back to outer cylinder 20 through the oil releasing valve 43. In addition, the outer cylinder 20 is made of transparent plastic material and has calibration at a region of suitable height on the wall, the amount of oil in the outer cylinder can be easily known, and because of this, oil can be added when it is practically necessary. Furthermore, the cylinder 37 of the plunger pump is also formed with a base portion by forging and is inserted in the corresponding hole on the base seat, and both are welded together. Besides, the plunger pump and the jack body are connected to each other by means of oil passage pipes 17, eliminating the trouble of boring oil passage in the base seat, and a covering mask is disposed on the oil passage pipes and connections to avoid direct collision of the pipes with other objects, moreover, the oil passage pipe and connections are installed in free space, oil leak in the pipe and the connections due to collision or aging can be easily detected. Thus, the base seat 16 of the present invention can be made of iron plate, its base area can be increased as determined by necessity and its weight is greatly decreased because two holes are bored on it.

In conclusion, the present invention—an improved hydraulic jack device, by improving the jack body, the plunger pump, the base seat and the oil passage devices of the prior art hydraulic jack, can attain and possess the following superiorities; because the outer cylinder and the inner cylinder of the jack body and the plunger pump are made of cylinder with base portions, there is no worry of oil leakage; moreover, because there is calibration on the outer cylinder, its oil content can be easily known; in addition, the weight of the whole structure is decreased and the base area of the base seat can be increased according to necessity without any trouble; because in the outer cylinder there is disposed a soft tube device, the jack can be used in any inclined position; further, because the oil passage pipe are installed in free space, so when there is oil leak due to aging or other causes, the problem can be easily solved; besides, when oil is to be added to the outer tube, the flange can be opened and oil added through the oil injection hole, or the oil can be added through the oil injection hole disposed on the outer wall of the outer cylinder. If the method as revealed by the spirit and embodiment of the present invention is suitably applied, it can be applied to the horizontal type (or oscillating arm type) hydraulic jack. The above description reveals that the present invention is a valuable invention, its consideration extends to every possibility of oil leak situations in the process of actual operation of the jack and provides for the avoidance of the occurrence of such situations, thus the value of practical application of the present invention is above any doubt, besides, similar structure has never been used in prior art hydraulic jack.

What is claimed is:

1. An improved hydraulic jack device comprising mainly a jack body, a base seat, a plunger pump and an oil passage device; wherein the jack body further comprising mainly an outer cylinder, an inner cylinder and a ram, the characteristic thereof being that the said outer cylinder is made of transparent or semi-transparent plastic material or the like, and is a cylindrical pipe with a hollow wall of rectangular cross section, and disposed thereon are an oil injection hole, an oil passage hole, a soft tube nozzle and a U shape notch, the said oil injection hole is connected to the oil releasing hole of the inner cylinder by means of an oil tube, the said oil passage hole communicates with the inner cylinder by means of an oil passage pipe and through a check valve, the said soft tube nozzle being communicable with the cylinder of the plunger pump through a check valve, and to the soft tube nozzle is connected a soft tube device disposed in the hollow wall space of the outer cylinder; further, calibration is marked at a region of the outer cylinder at a suitable height.

2. A jack body as defined in claim 1, wherein the said inner cylinder is made with a base portion by forging, being cylindrical in shape and fixedly welded to the base seat around the periphery of the corresponding hole bored thereon, making the inner cylinder oil-leak proof and at the same time reducing the weight of the base seat.

3. A plunger cylinder as defined in claim 1, wherein the cylinder of the said plunger pump is formed with a base portion by forging, being cylindrical in shape and welded to the base seat around the periphery of the corresponding hole bored thereon, making the said plunger cylinder oil-leak proof and at the same time reducing the weight of the said base seat.

4. A base seat as defined in claim 1, which is an iron plate with two holes bored thereon for accommodating respectively the inner cylinder and the plunger cylinder, said base having no oil passage bored therein.

* * * * *